US007140562B2

(12) United States Patent
Holzgrefe et al.

(10) Patent No.: US 7,140,562 B2
(45) Date of Patent: Nov. 28, 2006

(54) FUEL INJECTION VALVE

(75) Inventors: Volker Holzgrefe, Ditzingen (DE); Guenther Hohl, Stuttgart (DE); Michael Huebel, Gerlingen (DE); Juergen Stein, Illingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/451,556

(22) PCT Filed: Aug. 22, 2002

(86) PCT No.: PCT/DE02/03072

§ 371 (c)(1),
(2), (4) Date: Dec. 5, 2003

(87) PCT Pub. No.: WO03/038273

PCT Pub. Date: May 8, 2003

(65) Prior Publication Data

US 2004/0075002 A1 Apr. 22, 2004

(30) Foreign Application Priority Data

Oct. 24, 2001 (DE) ..... 101 52 416

(51) Int. Cl.
*F02M 61/00* (2006.01)

(52) U.S. Cl. ..... 239/533.12; 239/533.2

(58) Field of Classification Search .....
239/533.1–533.12, 533.2, 452, 456, 461–463; 123/498; 251/129.06
See application file for complete search history.

(56) References Cited

U.S. PATENT DOCUMENTS

| | | | | |
|---|---|---|---|---|
| 2,796,296 | A * | 6/1957 | Campbell | 239/452 |
| 4,197,997 | A * | 4/1980 | Wu et al. | 239/453 |
| 4,982,708 | A * | 1/1991 | Stutzenberger | 123/297 |
| 4,993,643 | A | 2/1991 | Schechter et al. | |
| 5,020,728 | A * | 6/1991 | Linder et al. | 239/533.12 |
| 6,042,028 | A * | 3/2000 | Xu | 239/585.1 |
| 6,585,171 | B1 * | 7/2003 | Boecking | 239/102.1 |

FOREIGN PATENT DOCUMENTS

| | | |
|---|---|---|
| DE | 231126 | 2/1910 |
| DE | 967935 | 12/1957 |
| DE | 3300670 | 8/1983 |
| DE | 40 05 455 | 8/1990 |
| DE | 68910775 | 3/1994 |
| DE | 195 34 445 | 3/1997 |
| DE | 196 42 653 | 1/1998 |
| WO | 01 11 228 | 2/2001 |
| WO | WO 01/25 619 | 4/2001 |

* cited by examiner

*Primary Examiner*—David A. Scherbel
*Assistant Examiner*—Seth Barney
(74) *Attorney, Agent, or Firm*—Kenyon & Kenyon

(57) ABSTRACT

A fuel injector for the direct injection of fuel into the combustion chamber of an internal combustion engine includes a valve needle situated in a nozzle body, the valve needle being actuable by an actuator and acted upon by a restoring spring in such a manner that a valve-closure member which is in operative connection to the valve needle and faces the combustion chamber is kept in sealing contact with a valve-seat surface in the non-actuated state of the actuator. A first jet-opening angle $\alpha_1$ is assigned to a first lift state of the valve needle and a second jet-opening angle $\alpha_2$ to a second lift state of the valve needle.

5 Claims, 2 Drawing Sheets

FUEL INJECTION VALVE

FIELD OF THE INVENTION

The present invention is directed to a fuel injector.

BACKGROUND INFORMATION

German Patent Application No. 195 34 445 refers to an outwardly opening fuel injector which has a conical sealing seat. The valve needle has a central bore which leads into a pressure chamber upstream from the sealing seat. An actuator, embodied as a piezoelectric actuator, is braced against a nozzle body on the one side and against a pressure shoulder, which is connected to the valve needle by force-locking, on the other side. A restoring spring keeps the valve needle in a closing position. In response to the actuator being energized, the valve needle, due to the actuator's longitudinal extension, is opened against the closing force of the restoring spring and fuel is spray-discharged.

One of the disadvantages of the fuel injector referred to in this reference is, in particular, that the fuel jet injected into the combustion chamber of the internal combustion engine has a conical shape and a particular opening angle $\alpha$. An injection at different opening angles $\alpha$, which takes into account, for example, the various demands on the form of the mixture cloud in the partial load and full load range, is not possible.

SUMMARY OF THE INVENTION

In contrast, the fuel injector according to the present invention has the advantage over the related art that, depending on the lift position of the valve needle, a larger or smaller spray-opening angle may be selected in accordance with the operating state of the internal combustion engine. This may advantageously be realized by an easily producable geometry of the end of the fuel injector adjacent to the sealing seat. For this purpose, an inclined region, whose angle of inclination deviates from that of the valve-seat surface, may be formed adjacent to the valve-seat surface.

It is also advantageous that by an appropriate form of the downstream-side end of the fuel injector and by a corresponding design of the valve-closure member, any desired jet angle may be realized.

DETAILED DESCRIPTION

Figure 1:
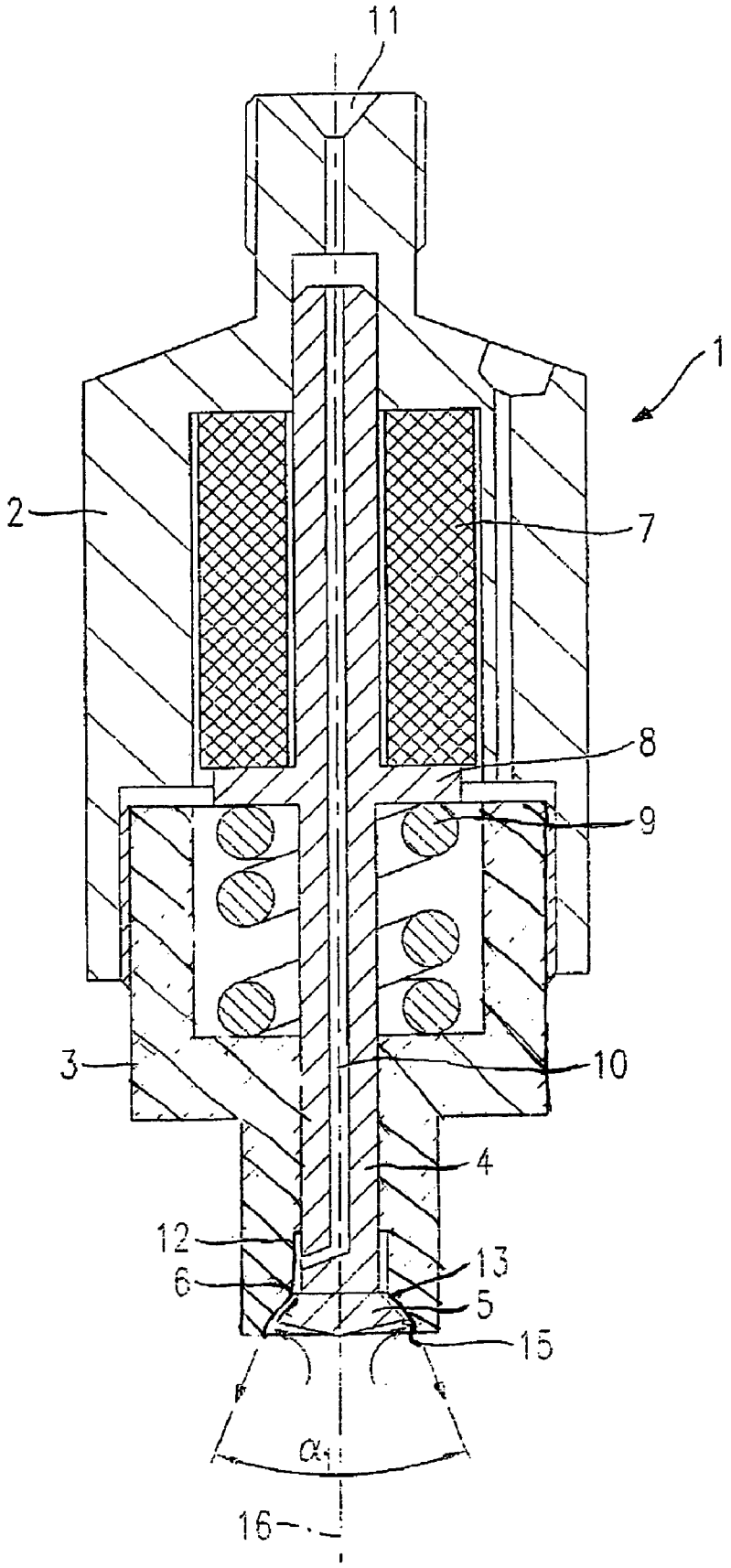
FIG. 1 shows a section through an exemplary embodiment of a fuel injector according to the present invention, in a first lift position.
Figure 2:
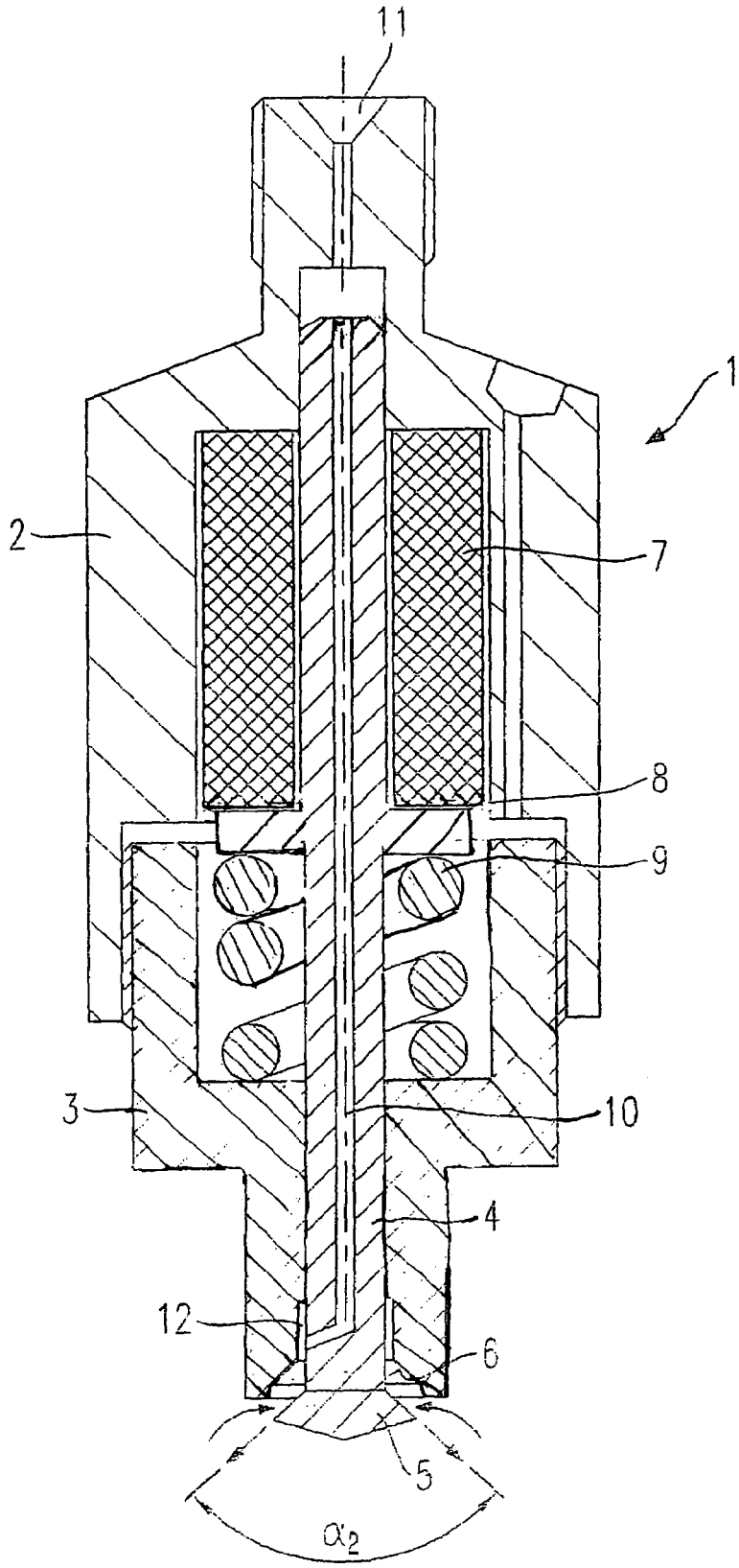
FIG. 2 shows a section through another exemplary embodiment of a fuel injector according to the present invention, in a second lift position.

An exemplary embodiment of a fuel injector 1 according to the present invention, shown in two different lift states in FIGS. 1 and 2, may be implemented in fuel-injection systems of mixture-compressing internal combustion engines having externally supplied ignition. Fuel injector 1 is particularly suited for the direct injection of fuel into a combustion chamber (not shown) of an internal combustion engine.

Fuel injector 1 includes a housing body 2 and a nozzle body 3, in which a valve needle 4 is positioned. Valve needle

4 is in operative connection to a valve-closure member 5 which cooperates with a valve-seat surface 6 to form a sealing seat. The fuel injector in the exemplary embodiment is an outwardly opening fuel injector 1. It includes an actuator 7 which is embodied as a piezoelectric actuator 7 in the exemplary embodiment. The actuator is braced on one side on housing body 2, and on the other side on a shoulder 8 which is in operative connection to valve needle 4. Downstream from shoulder 8 is a restoring spring 9 which in turn is braced on nozzle body 3.

Valve needle 4 has a fuel channel 10 through which the fuel, conveyed through a central fuel feed 11 on the inflow side, is guided to the sealing seat. On the inflow side of the sealing seat, a swirl chamber 12 is formed into which fuel channel 10 opens.

In the rest state of fuel injector 1, shoulder 8 is acted upon by the force of restoring spring 9, against the lift direction, in such a way that valve-closure member 5 is held in sealing contact on valve-seat surface 6. In response to piezoelectric actuator 7 being energized, it expands in the axial direction, counter to the spring force of restoring spring 9, so that shoulder 8 with valve needle 4, which is joined to shoulder 8 by force-locking, is moved in the lift direction. Valve-closure member 5 lifts off from valve-seat surface 6, and the fuel conveyed via fuel channel 10 is spray-discharged.

When the piezoelectric actuator is discharged, the axial extension of piezoelectric actuator 7 is reduced, so that valve needle 4, due to the pressure of restoring spring 9, is moved counter to the lift direction. Valve closure member 5 comes to rest on valve-seat surface 6, and fuel injector 1 is closed.

In partial-load operation, a mixture-compressing internal combustion engine having external ignition places different demands on the form, stoichiometry and penetration capability of the mixture cloud injected into the combustion chamber than it does in full-load operation. In partial-load operation, the mixture cloud, as shown in FIG. 1, should have a relatively small opening angle $\alpha 1$, high penetration capability, a small core region, due to the small opening angle $\alpha_1$, with a fatter mixture, and a very lean envelope. In contrast, in full-load operation, as shown in FIG. 2, a large opening angle $\alpha_2$ and, thus, a nearly homogenous charge of the cylinder with ignitable mixture is more suitable.

In order to take these characteristics of the mixture formation into account, two lift states are defined for fuel injector 1 according to the present invention, thereby making it possible during operation to produce various jet patterns which may be selected in accordance with the operating state of the internal combustion engine.

FIG. 1 shows fuel injector 1 in a first lift state. Valve-closure member 5 has already lifted off from valve-seat surface 6, but only releases a narrow gap 13 between valve-closure member 5 and valve-seat surface 6. Due to the geometry of the downstream end 14 of fuel injector 1 which, in an inclined region 15 downstream from valve-seat surface 6, has less of an angle relative to a longitudinal axis 16 of fuel injector 1 than valve-seat surface 6, the fuel jet spray-discharged from gap 13 in the first lift state, which is shown in FIG. 1, is tangential to the inclined region 15 of downstream end 14 of fuel injector 1 because of the entrainment of the flow in the interior of the fuel jet. This makes it possible to produce a fuel jet having a small opening angle $\alpha_1$ which has the high penetration capability for stratified operation.

FIG. 2 shows a second lift position of fuel injector 1. Here, valve-closure member 5 has shifted further away from valve-seat surface 6, so that gap 13 is wider than in FIG. 1. Due to the entrainment of the flow on the outside of the injection jet of gap 13, the spray-discharged fuel jet is now tangential to valve-closure member 5 which has a large incline or angle relative to longitudinal axis 16 of fuel injector 1, thus resulting in a considerable widening of the fuel jet. Therefore, opening angle $\alpha_2$ is enlarged when compared to the first lift position, which is advantageous for full-load range of the internal combustion engine since the entire combustion chamber is filled with a relatively homogenous stoichiometric mixture.

The various lift positions of valve needle 4 may be actuated in a simple manner, for instance, by using two separately actuable actuators 7. These may be, for instance, a voltage-regulated or voltage-controlled piezoactuator and two piezoelectric actuators 7 which are controlled in succession. The use of two magnetic circuits having two separate coils, or a bipartite magnetic armature may also be used.

By a suitable selection of the inclines of valve-seat surface 6 or of valve-closure member 5 and inclined region 15, jet angles $\alpha_1$ and $\alpha_1$ may be selected in such a way that the combustion chamber of the internal combustion engine is able to be filled with an ignitable fuel-air mixture in an optimal manner. Inclined region 15 and valve-seat surface 6 may be produced, for instance, during the manufacture of nozzle body 3, by turning on a lathe, for example.

The present invention is not limited to the exemplary embodiments shown, but may also be applied, in general, to configurations of fuel injectors having any number of actuators.

What is claimed is:

1. A fuel injector for directly injecting fuel into a combustion chamber of an internal combustion engine, comprising:

a nozzle body;

an actuator;

a valve needle situated in the nozzle body, coupled to a restoring spring, and actuable by the actuator;

a valve-closure member operably connected to the valve needle and facing a combustion chamber; and a valve-seat surface;

wherein, during opening of the valve needle, the valve needle is configured to move between a first lift state, for providing partial-load operation of the internal combustion engine, and a second lift state, for providing full-load operating of the internal combustion engine, each of the lift states provide for different jet patterns during operation and are selectable in accordance with the operating state of the internal combustion engine, wherein a first jet-opening angle corresponds to the first lift state of the valve needle and a second jet-opening angle corresponds to a second lift state of the valve needle;

wherein a mixture cloud injected into the combustion chamber has the first jet-opening angle in the first lift state of the valve needle and the second jet-opening angle in the second lift state of the valve needle, the first jet-opening angle is smaller than the second jet-opening angle.

2. The fuel injector of claim 1, further comprising:

an inclined region formed adjacent to the valve-seat surface at a downstream end of the fuel injector.

3. The fuel injector of claim 2, wherein an angle between the inclined region and a longitudinal axis of the fuel injector is less than an angle between the valve-seat surface and the longitudinal axis of the fuel injector.

4. The fuel injector of claim 3, wherein the first jet-opening angle is double the angle of the inclined region with respect to the longitudinal axis of the fuel injector.

5. The fuel injector of claim 3, wherein the second jet-opening angle is double the angle of the valve-seat surface with respect to the longitudinal axis of the fuel injector.

* * * * *